US007673877B2

(12) United States Patent
Ruddell

(10) Patent No.: US 7,673,877 B2
(45) Date of Patent: Mar. 9, 2010

(54) PNEUMATIC GAME

(76) Inventor: Terry Ruddell, 777 Shetland Court, Oshawa, Ontario (CA) L1J 7R3

( * ) Notice: Subject to any disclaimer, the term of this patent is extended or adjusted under 35 U.S.C. 154(b) by 457 days.

(21) Appl. No.: 11/554,922

(22) Filed: Oct. 31, 2006

(65) Prior Publication Data

US 2008/0122170 A1 May 29, 2008

(51) Int. Cl.
*A63F 7/07* (2006.01)
*G05G 9/053* (2006.01)

(52) U.S. Cl. ..... 273/126 A; 463/38; 273/108; 273/129 AP

(58) Field of Classification Search ..... 273/108.1, 273/108.33, 109, 120 A, 121 A, 108, 126, 273/129, 129 AP; 463/38
See application file for complete search history.

(56) References Cited

U.S. PATENT DOCUMENTS 3,113,776 A * 12/1963 Romei ..... 273/108.57
3,771,789 A * 11/1973 Kammerl ..... 273/108.57
4,014,543 A * 3/1977 Arad ..... 273/108.53
4,830,374 A * 5/1989 Follo ..... 273/317.7
5,272,955 A * 12/1993 Bond et al. ..... 89/37.04
5,658,198 A * 8/1997 Nagasaka et al. ..... 463/64
6,048,271 A * 4/2000 Barcelou ..... 463/48
6,105,961 A * 8/2000 Price ..... 273/108.52
6,454,260 B1 * 9/2002 Noolandi et al. ..... 273/108
7,086,922 B2 * 8/2006 Delgado ..... 446/429
2005/0127601 A1 * 6/2005 Giegerich et al. ..... 273/108.1
2006/0125790 A1 * 6/2006 Edmunds ..... 345/161
2006/0127247 A1 * 6/2006 Caddell ..... 417/413.1

* cited by examiner

*Primary Examiner*—John M Hotaling
*Assistant Examiner*—Justin Myhr
(74) *Attorney, Agent, or Firm*—Mark B. Eisen; Dimock Stratton LLP

(57) ABSTRACT

A game that uses a source of compressed gas, such as compressed air, to provide gas to move a play object across a play surface. The compressed gas source is capable of providing compressed gas to jets in communication with the play surface for directing the gas to move the play object across the play surface. A triggering device allows the player to select one or more jets and selectively trigger the flow of gas from a selected jet.

20 Claims, 19 Drawing Sheets

29
TO I/O
180
170
175
70
31
JPY1 JET5
JPY1 JET10
JPY2 JET1
JPY2 JET6
JPY1 JET15
JPY2 JET11
JPY1 JET1
JPY1 JET6
JPY2 JET15
JPY2 JET10
JPY2 JET5
90
95
AIR IN
120VAC
85
82
80
185
JOYSTICK TRIGGER & POSITION SIGNALS
40

29
TO I/O
180
170
175
70
31
JOY1 JET5
JOY1 JET10
JOY2 JET11
JOY2 JET15
JOY1 JET15
JOY2 JET16
JOY2 JET1
JOY1 JET1
JOY1 JET6
JOY2 JET10
JOY2 JET5
90
95
AIR IN
120VAC
85
82
80
185
JOYSTICK TRIGGER & POSITION SIGNALS
PUMP ENABLE SIGNAL
45

105

100
75
110
130
105

100
75
110
125
130
122
135
105
132

100
110
130
122
105

PNEUMATIC GAME

FIELD OF THE INVENTION

This invention relates to games. In particular, this invention relates to a game in which a frame supporting a play surface is equipped to move a play object across the play surface.

BACKGROUND OF THE INVENTION

Many games, such as foosball, air hockey and billiards, involve play on a surface supported by a frame, such as a table. Foosball (or "table football" as it is known in Europe), for example, emulates the game of soccer and involves the turning or spinning of players fixed to rods to strike a ball towards an opponent's goal.

Air hockey involves an air hockey table and players striking a puck with a mallet towards an opponent's goal. Air hockey tables typically have some mechanism that produces a flow of air from the play surface that opposes the force of gravity, for the purpose of reducing friction and increasing play speed.

Billiards is another in this family of games, played on a table with a stick used to strike balls, moving them around the table and eventually into pockets.

BRIEF DESCRIPTION OF THE DRAWINGS

In drawings which illustrate by way of example only a preferred embodiment of the invention.

DETAILED DESCRIPTION OF THE INVENTION

Figure 1:
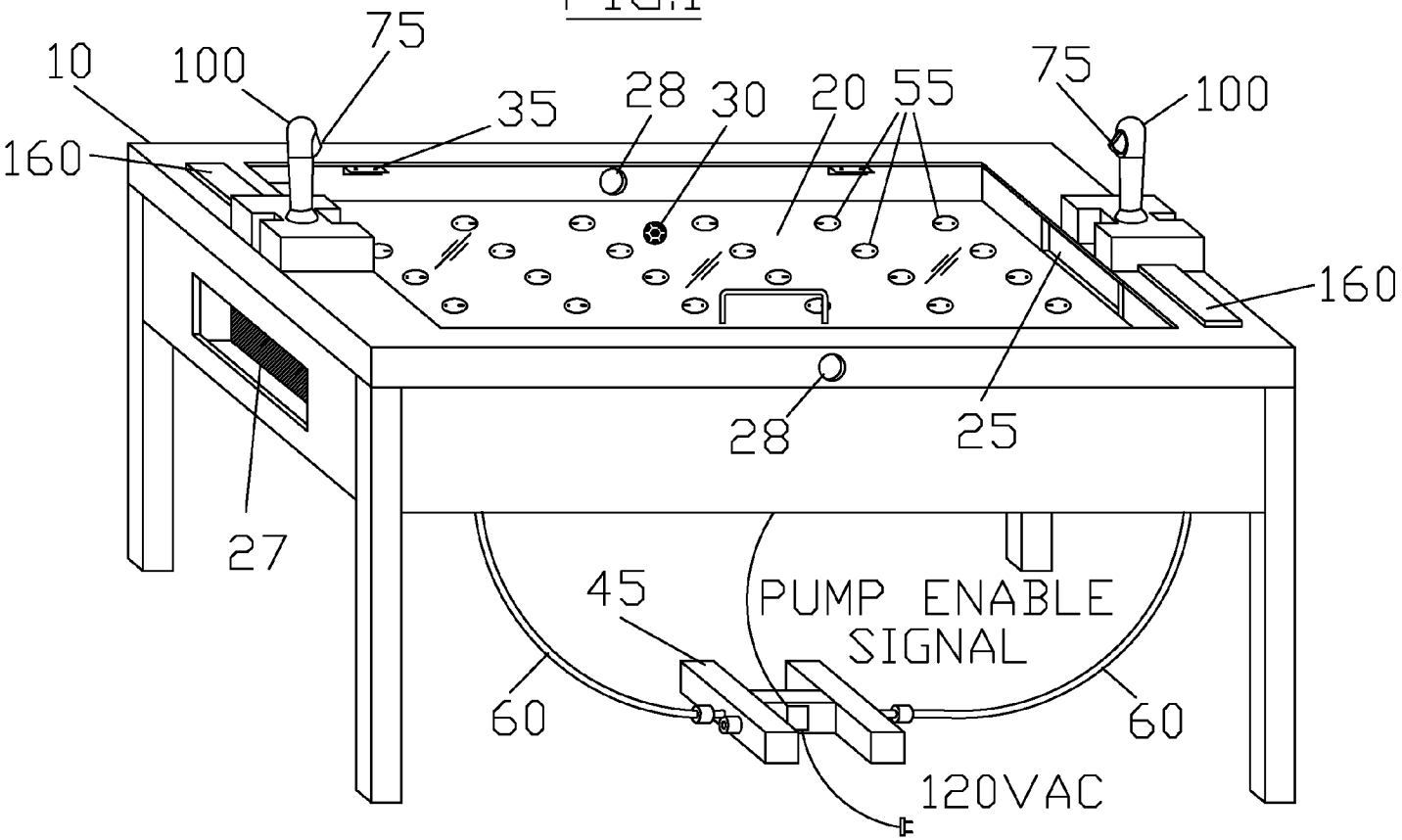
FIG. 1 shows a front perspective view of a game table that uses a linear magnetic pump as a source of compressed gas.
Figure 1A:
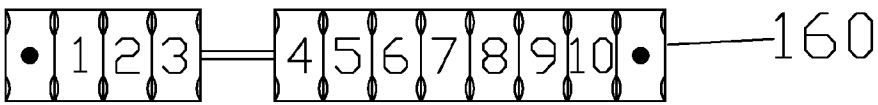
FIG. 1A shows a plan view of the manual score keeping mechanism of the game table of FIG. 1.

This invention relates to a game which uses triggered directed blasts of gas, such as air, to move a play object across a play surface.

The preferred embodiment of the invention is accomplished by providing a game comprising: a frame supporting a play surface, for supporting a play object; a source of compressed gas capable of providing gas for moving the play object across the play surface; a plurality of jets in communication with the play surface for directing the gas to move the play object across the play surface, the plurality of jets being coupled to the source of compressed gas by a plurality of conduits; one or more triggering devices, each for allowing a player to select one or more jets and selectively trigger the release of gas from the one or more selected jets; and a controller coupled to the triggering devices and a plurality of valves, the plurality of valves being biased towards a closed position which prevents gas flow through the plurality of conduits, whereby the controller selects one or more valves based on the one or more selected jets and causes the one or more selected valves to open in response to the trigger, to allow the gas to move through the one or more selected jets for delivery to the play surface.

A further embodiment of the invention is accomplished by providing a game comprising: a frame supporting a play surface, for supporting a play object; a source of compressed gas capable of providing gas for moving the play object across the play surface; a plurality of jets in communication with the play surface for directing the gas to move the play object across the play surface, the plurality of jets being coupled to the source of compressed gas by a plurality of conduits; and one or more triggering devices for allowing a player to selectively trigger the gas from at least one jet, the triggering devices coupled to the source of compressed gas and to a plurality of conduits coupled to the plurality of jets, whereby the trigger allows the gas to move from the source of compressed gas through a selected conduit originating at the triggering device to one or more jets and through the one or more jets to the play surface, whereby the selected conduit was selected based on the position of the triggering device.

A further aspect of the invention is accomplished by providing a pneumatic joystick comprising: an input for receiving gas; one or more outputs for delivering gas; a ball having a conduit one end of which is coupled to the input and the other end of which is aligned to be in communication with at least one of the outputs through rotation of the ball; a ball-rotating member connected to the ball for rotating the ball; a trigger engaging a blocking member within the ball-rotating member, the blocking member blocking gas from flowing between the input and the outputs when the trigger is not depressed, and the trigger moving the blocking member when the trigger is depressed to allow gas to flow between the input and at least one of the outputs.

The game played in the preferred embodiment of the present invention is a game in which players select jets and trigger blasts of air from selected jets, which are in communication with the play surface, to direct a ball or other play object into a goal or other scoring or point changing location in order to score points. The game typically involves two people, but other embodiments may involve only one person or more than two people. A one-player mode allows for play against a computer-controlled opponent. Two-player mode is one player versus another player. Three or more player mode allows two or more teams to compete against each other where one or more teams have more than one player and the control of jets is divided so that one player controls only a portion of that team's jets.

Figure 2:
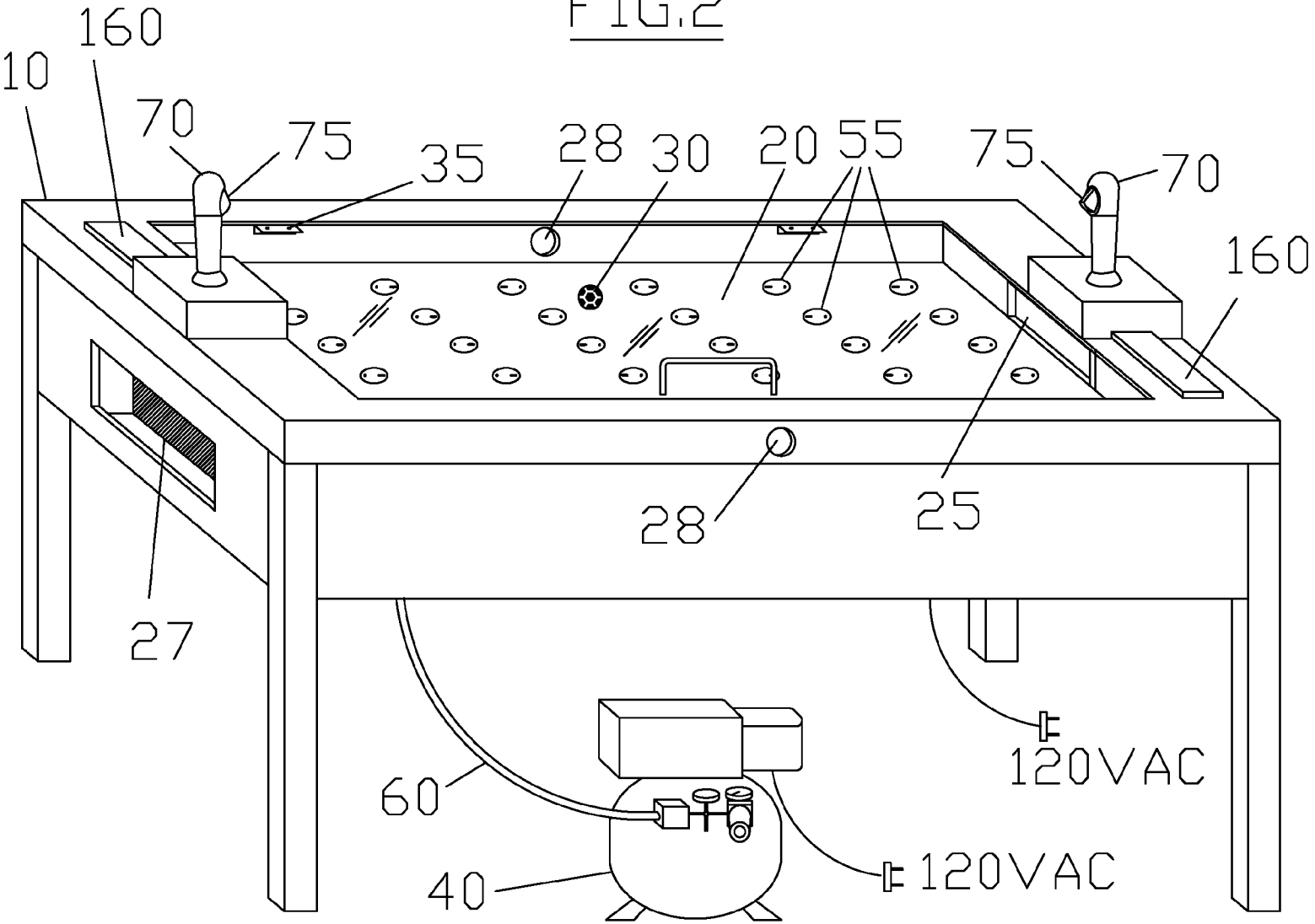
FIG. 2 shows a front perspective view of a game table that uses an air compressor as a source of compressed gas.

As shown in FIGS. 1 and 2, the frame 10, such as a game table, supports a play surface 20 that is suited to a particular game. The frame 10 may be whatever shape or size or material necessary to support the play surface 20. Where the table 10 is designed for soccer, for example, as in the embodiment illustrated, the table 10 may be similar in size and shape to a foosball table. The play surface 20 in the 'air soccer' embodiment of the invention is substantially flat, and may be green to resemble a soccer field, and includes goals 25 at both ends of the play surface 20. The play surface 20 may be either smooth or rough in texture, as desired. In other embodiments of the present invention, for example golf, the playing surface may be provided with "hills" and/or with obstacles for the players to avoid or overcome.

Figure 7:
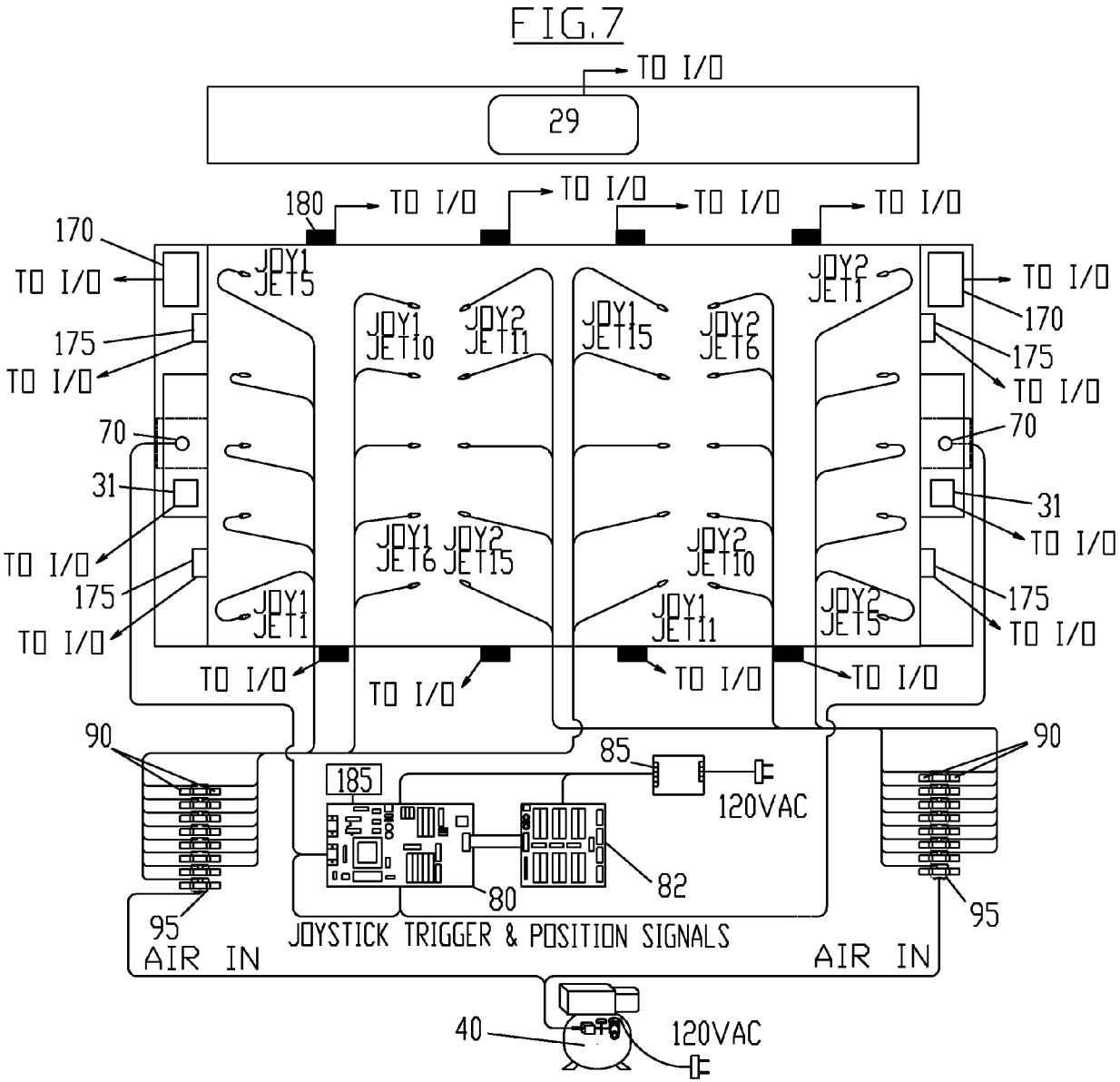
FIG. 7 shows a schematic view of the connections for a game table configured with a controller and distance measuring sensors, where a compressor is used as a source of compressed gas.
Figure 8:
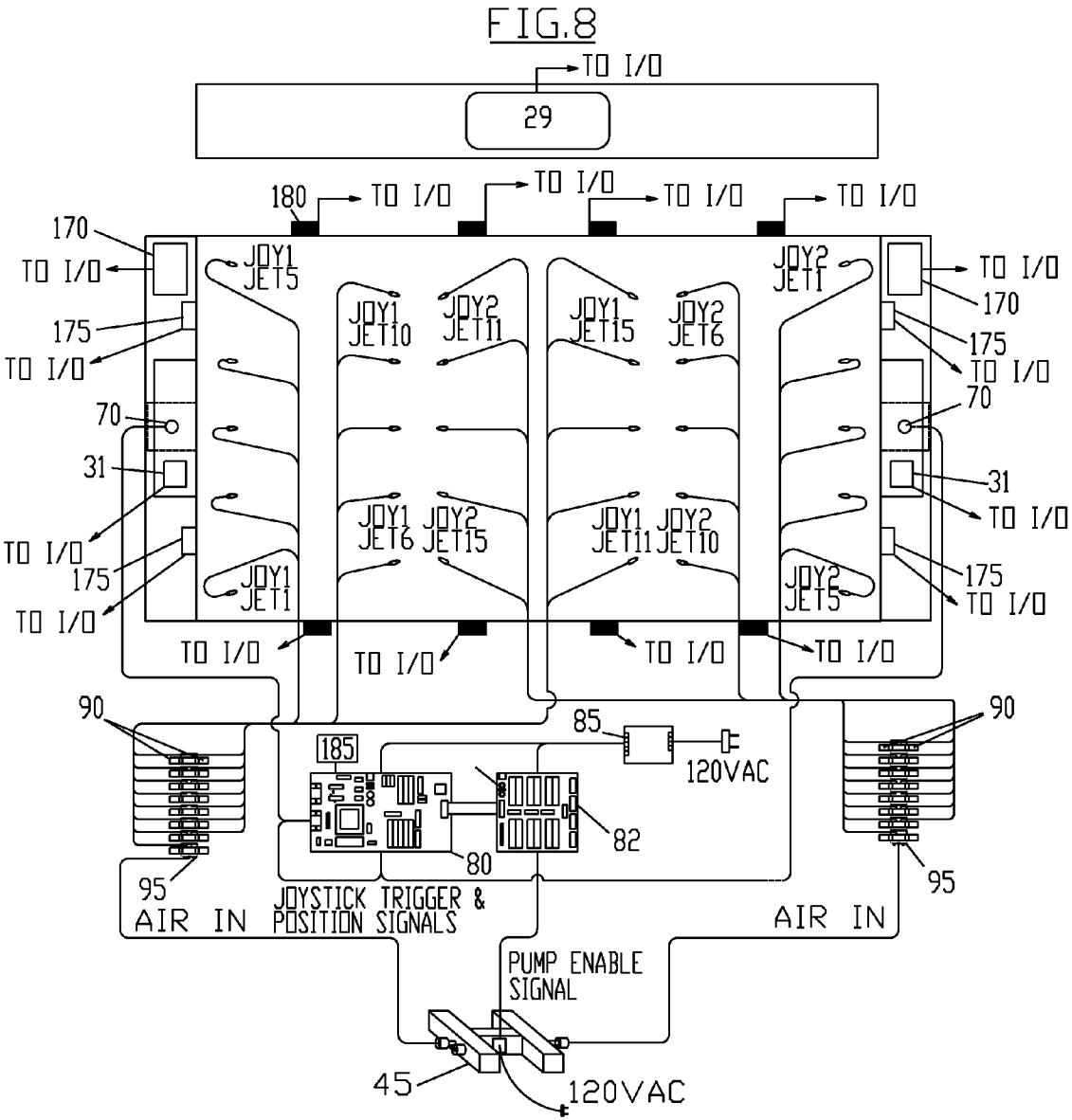
FIG. 8 shows a schematic view of the connections for a game table configured with a controller and distance measuring sensors, where a linear magnetic pump is used as the source of compressed gas.
Figure 9:
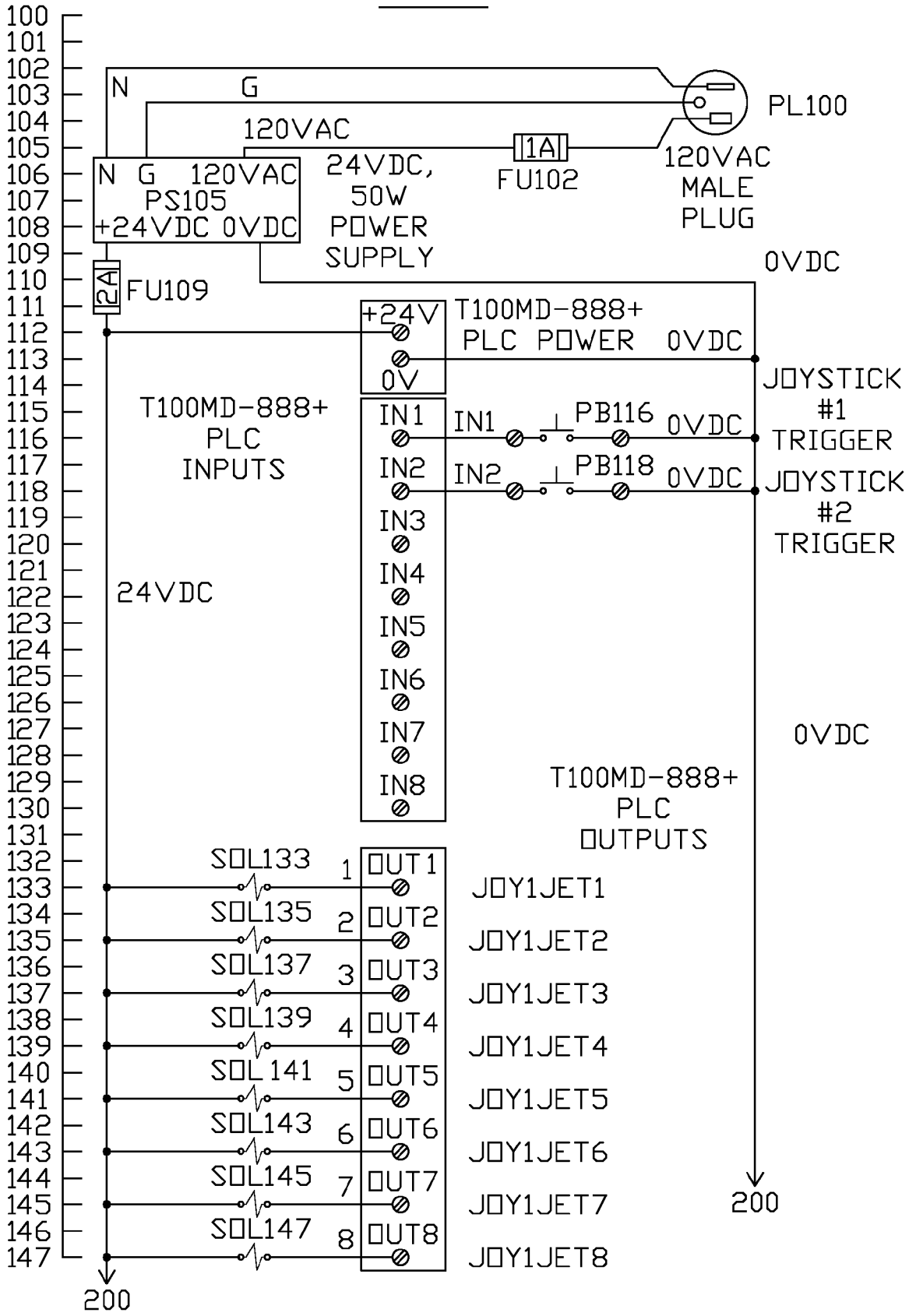
FIGS. 9 to 12 show schematic diagrams of electrical and pneumatic connections according to an embodiment of the invention.
Figure 10:
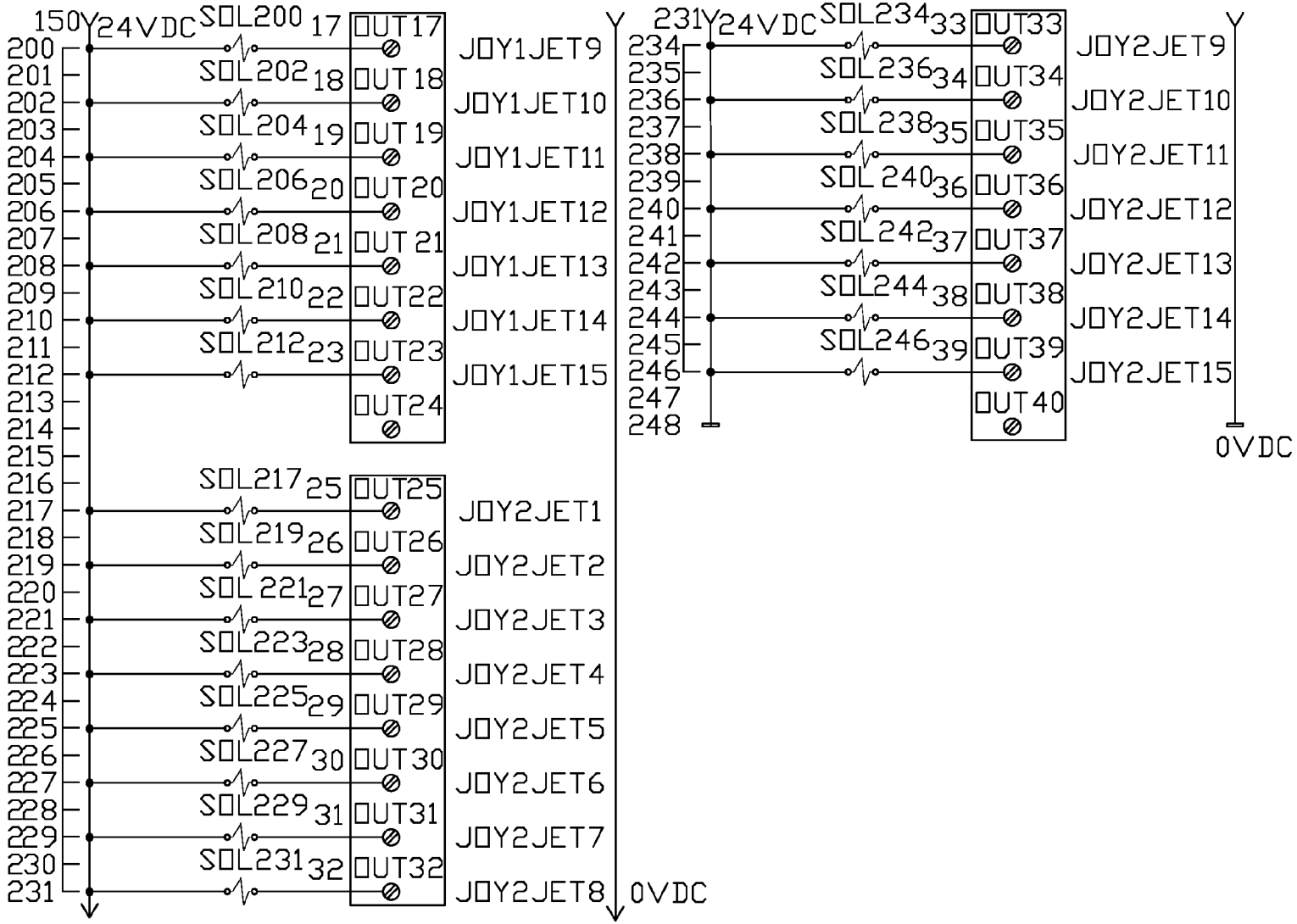
Figure 11:
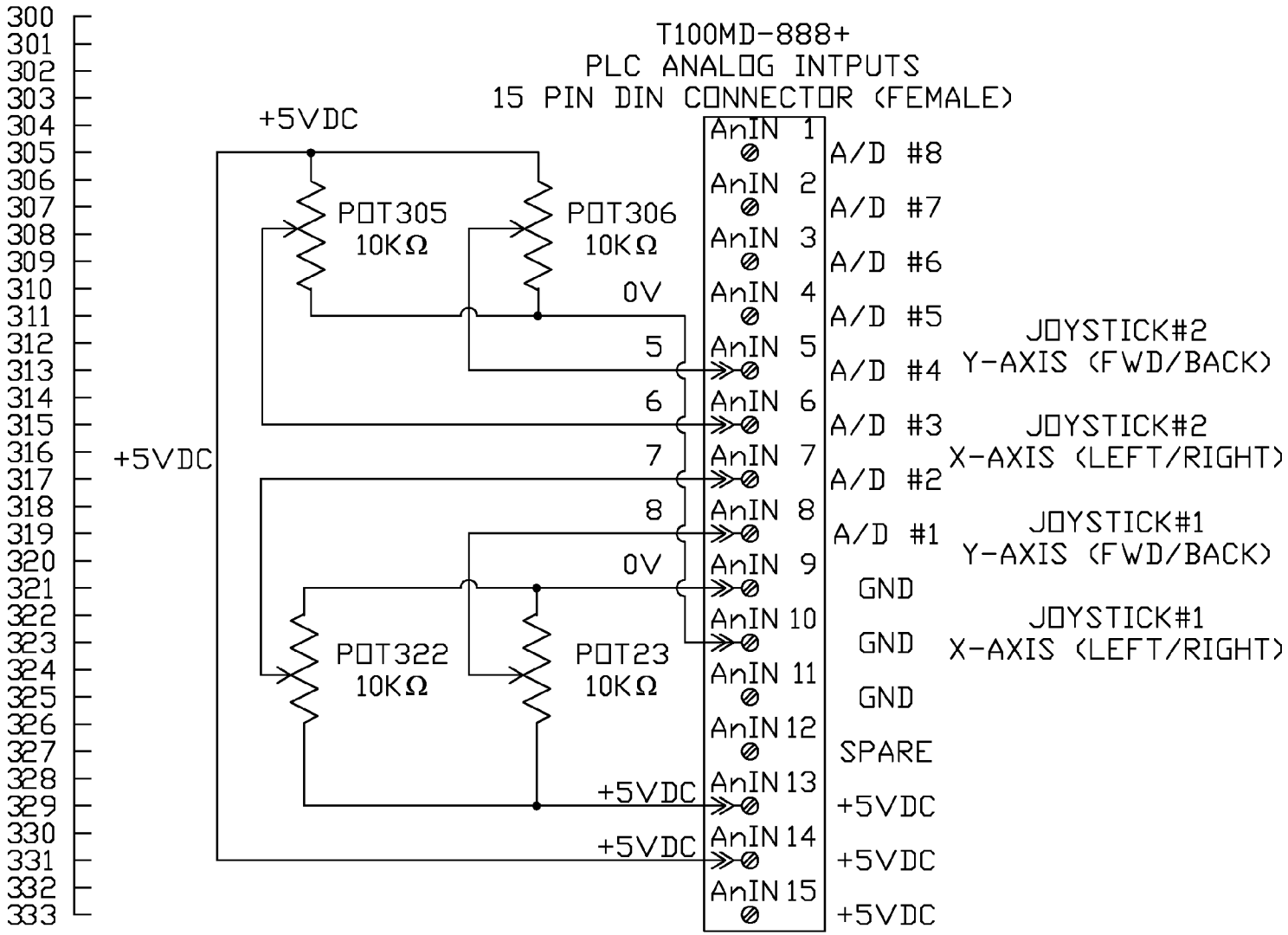
Figure 12:
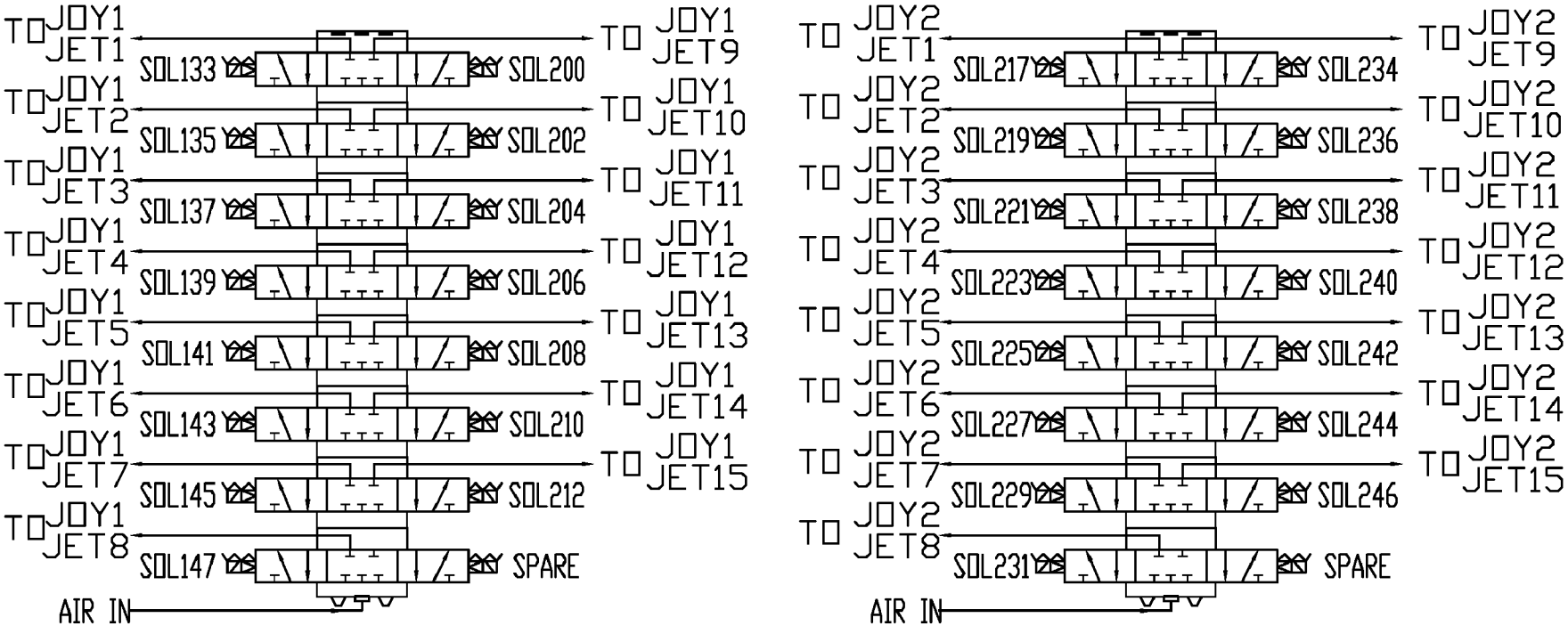

The game table 10 should provide sufficient stability for rough play, and preferably have areas for a logo or nameplate and for score keeping. The game table 10 may also include a play object return 27 for returning the play object after a point or goal is scored. The game table 10 may also accommodate mechanisms for coin- or credit card-operated use 29 as shown in FIGS. 7 and 8, including a ball release valve 31, for example for use in commercial establishments such as restaurants, bars, or arcades.

Figure 3:
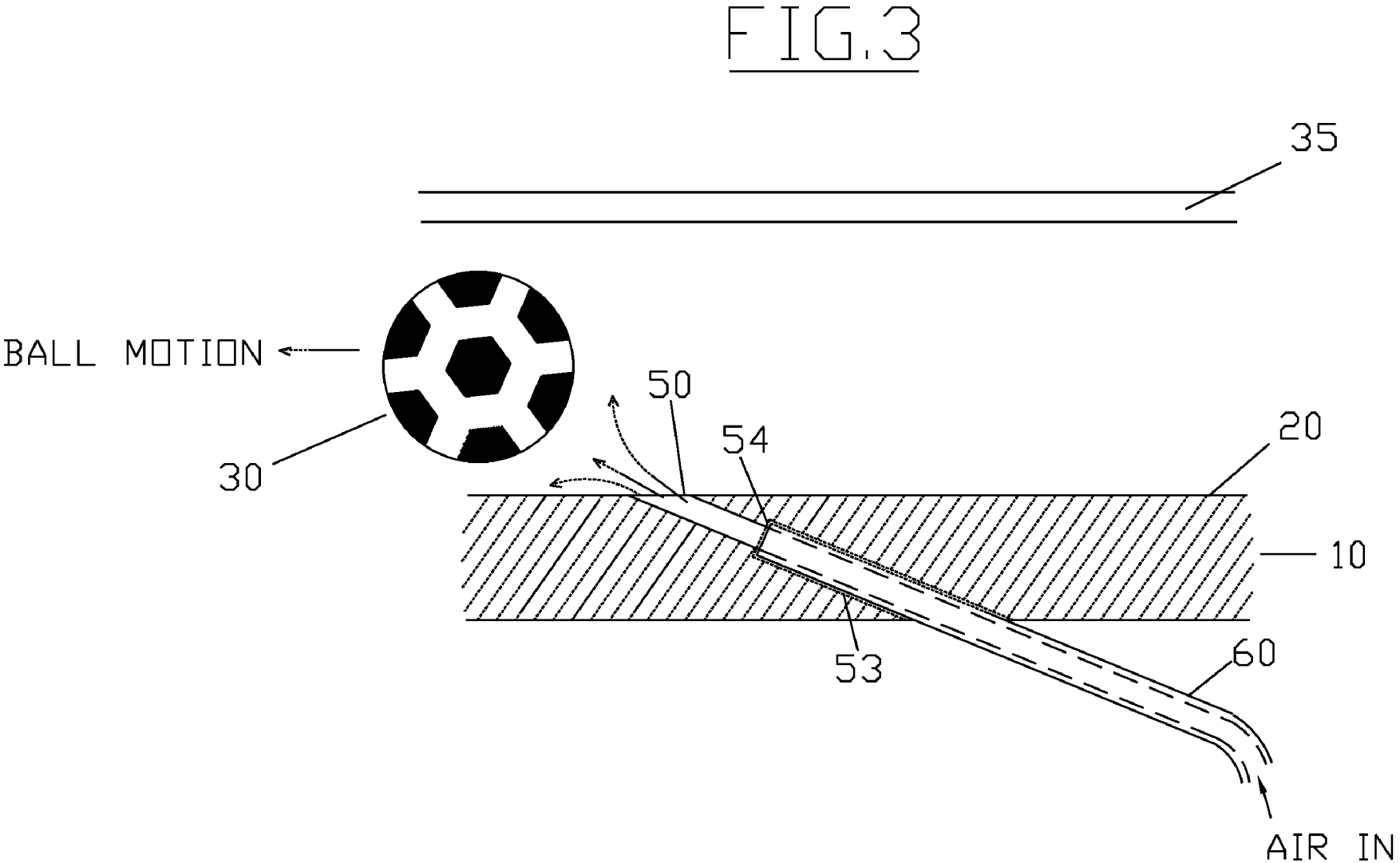
FIG. 3 shows an elevational view of a blast of gas from ajet directing a play object.

Referring now to FIG. 3, the play object 30, for example a hollow ball, is light enough to be moveable by a flow of gas, such as air. Suitable materials include plastic, cork and other lightweight materials. Where the game is soccer, the play object 30 is preferably about the size and weight of a ping-pong ball and may be thematically coloured white, yellow, or black and white, or black and yellow in the pattern of a soccer ball.

An enclosing cover 35, which is preferably transparent plastic, may be attached to the table 10 so as to be positioned a sufficient distance above the play surface 20 to allow room for the play object 30 to rise above the play surface 20, and still allow players to view the play surface 20. The enclosing cover 35 may be flat or curved, and close to the play surface 20 or farther away, as desired. The enclosing cover 35 shields the play surface 20 from air currents proximate the play surface 20 which might oppose or affect the bursts of gas from the jets 50, thus providing more reliable movement and speed of the play object 30 during play. The enclosing cover 35 also prevents the play object 30 from leaving the play surface 20 and game table 10 entirely, and protects the play surface 20 and jets 50 from food and drink spills or other damage. Enclosing cover 35 may include an opening for inserting the play object 30 to start or resume play. Alternatively, there may be an opening 28 in the walls of game table 10 for inserting the play object 30 to start or resume play.

The source of compressed gas is capable of providing a flow of gas (for example air) sufficient to move the play object 30 across the play surface 20 of the game table 10. Gas may be supplied by a compressor 40 or an air pump, such as a linear magnetic pump 45, or from a compressed gas canister or any other suitable source of compressed gas, at a pressure sufficient to provide the flow of gas necessary to move the play object 30 across the play surface 20. In a preferred embodiment, the source of compressed gas may be mounted on game table 10, for example to the underside of the table 10.

In a preferred embodiment, the source of compressed gas contains air at a pressure of 30-60 psi (1-2 scfm), which is suitable for use with 0.25" pneumatic tubing to move a play object 30 that is about the size and weight of a ping-pong ball. Different pressures may be used, varying with the cross-sectional area of the jets 50, the size and weight of the ball, and the shape and friction of the play surface 20 and the desired play object speed.

Figure 6A:
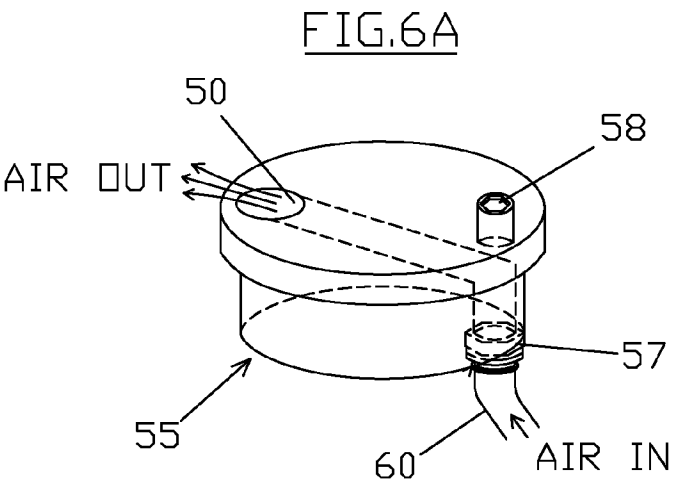
FIGS. 6A to 6C respectively show a front perspective view (from above), a top side view and a side sectional of a jet module.
Figure 6C:
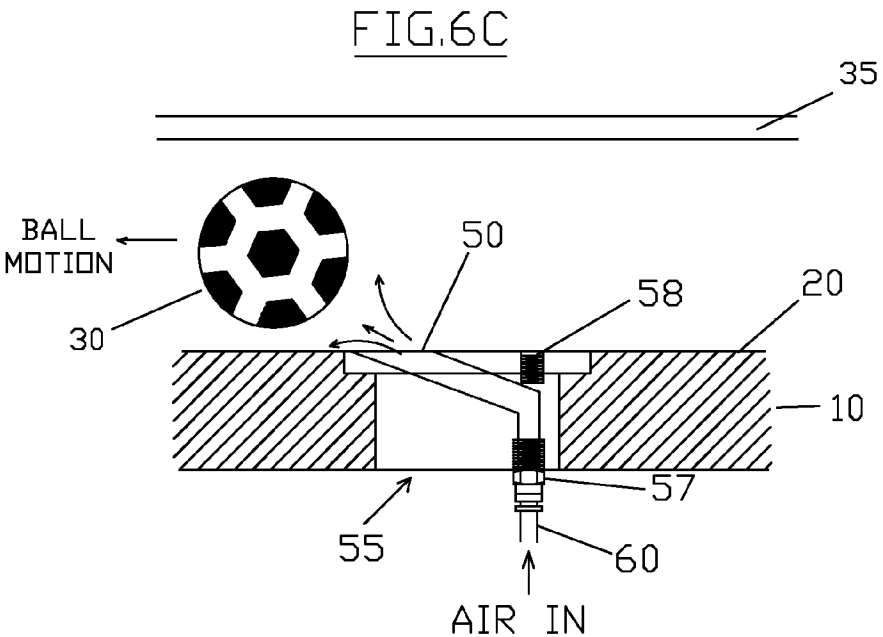
Figure 6B:
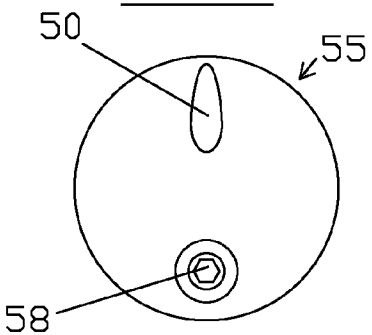

A plurality of jets 50 are positioned in communication with, preferably proximate to, the play surface 20, for directing the flow of gas to move the play object 30 across the play surface 20. The plurality of jets 50 is coupled to the source of compressed gas by a plurality of isolated conduits such as pneumatic tubing 60. In a preferred embodiment, a jet 50 has a teardrop-shaped opening, as shown in FIG. 6B, and the jet 50 is at a preferred 10 to 30 degree angle to the plane of the play surface surrounding the opening, as shown in FIG. 6C, so the flow of gas out of the jet 50 directs the play object 30 in a forward motion as opposed to up and off the play surface 20.

Each jet 50 may be stationary or adjustable. If the jet is stationary, it is preferably integral with the game table 10 and its orientation cannot be adjusted. In the embodiment shown in FIG. 3, the jet 50 is integral to the game table 10 and there is a channel through the table 10 to the jet 50. Preferably, the channel has a tube receiving portion 53 and a tube blocking portion 54. The tube receiving portion 53 has a circumference large enough to allow pneumatic tubing 60 to be inserted into and pushed up the channel until the pneumatic tubing 60 reaches the tube blocking portion 54. The circumference of the tube blocking portion 54 is sized to prevent the pneumatic tubing 60 from entering the tube blocking portion 54 of the channel while allowing gas to flow from the pneumatic tubing 60 through the tube blocking portion 54 of the channel to the jet 50.

If the jet 50 is to be adjustable then the jet 50 may alternatively be incorporated within a jet module 55. A jet module 55, shown in FIGS. 6A to 6C, can be a removable component that may be affixed to or removed from the game table 10 by the player and may be rotated by the player before or even during play. Rotating the jet module 55 changes the direction of the jet 50 so that gas from the jet 50 will direct the play object 30 in a different direction when triggered, potentially allowing a player to make passes to other jets or shots off the side or back walls of the game table 10. A jet module 55 includes a fitting 57 for securing the conduit such as pneumatic tubing 60 for delivery of the compressed gas, such as air, to the jet 50. In the preferred embodiment, each jet module 55 is substantially made of plastic and includes a receptacle such as a hex hole 58 for inserting a tool to rotate the module in order to adjust the jet direction. A jet module 55 may alternatively be made of wood, metal or rubber. A portion of the exterior of the jet module 55 forms part of play surface 20.

Figure 4:
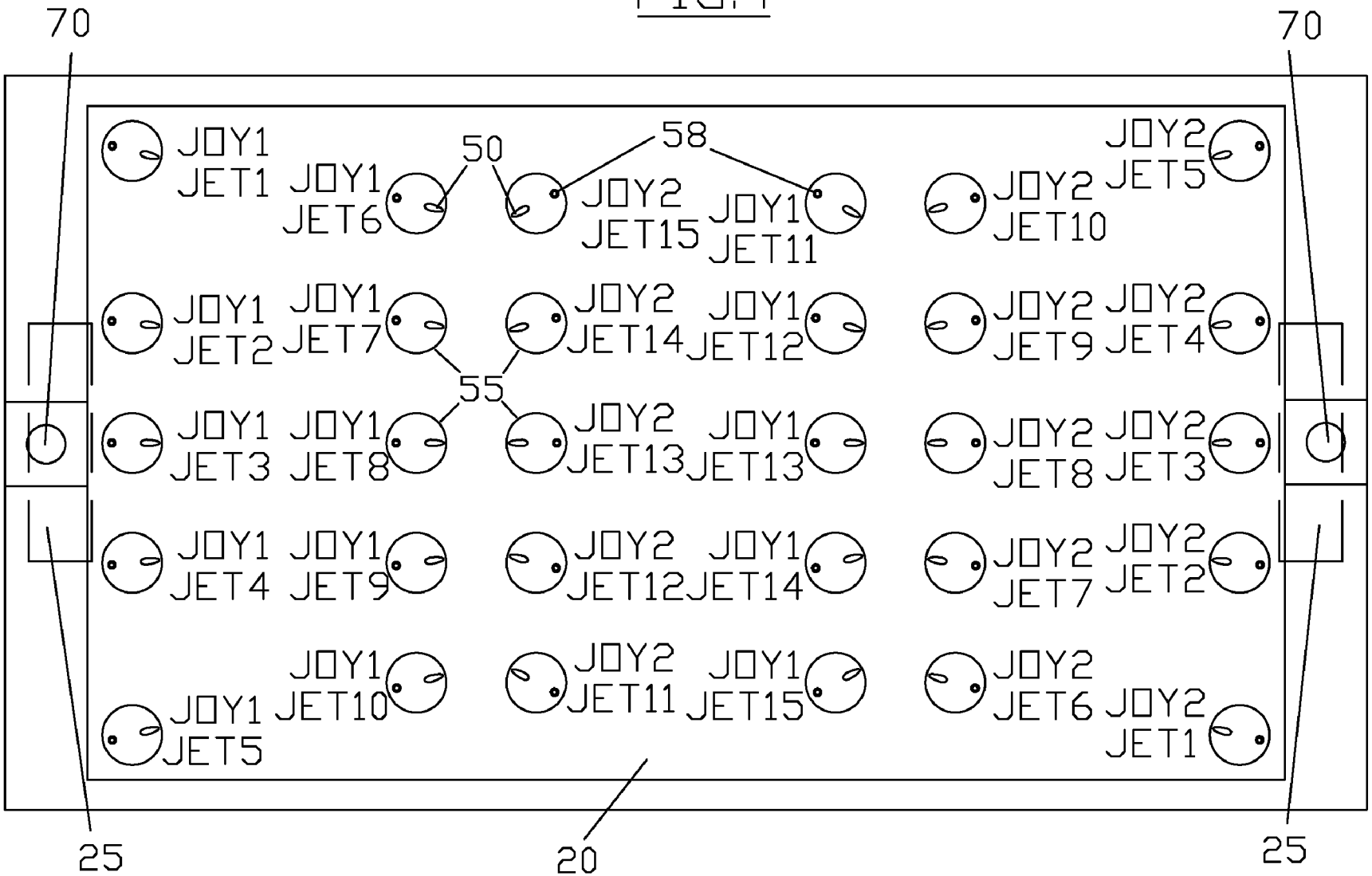
FIG. 4 shows a plan view of the game table of FIG. 2.

In a preferred embodiment for the game of soccer as illustrated in FIG. 4, there are fifteen jets 50 per team denoted as JOY1JET1 to JOY1JET15 and JOY2JET1 to JOY2JET15: five forward jets denoted as JOY1JET11 to JOY1JET15 and JOY2JET11 to JOY2JET15, five middle jets denoted as JOY1JET6 to JOY1JET10 and JOY2JET6 to JOY2JET10 and five back jets denoted as JOY1JET1 to JOY1JET5 and JOY2JET1 to JOY2JET5. Each jet 50 is intended to be the counterpart of a player on a team in a real game of soccer. Moreover, everyjet 50 or a marker proximate to it is preferably colour-coded or otherwise pattern-coded to identify it as associated with the particular player or team who controls it.

Figure 5:
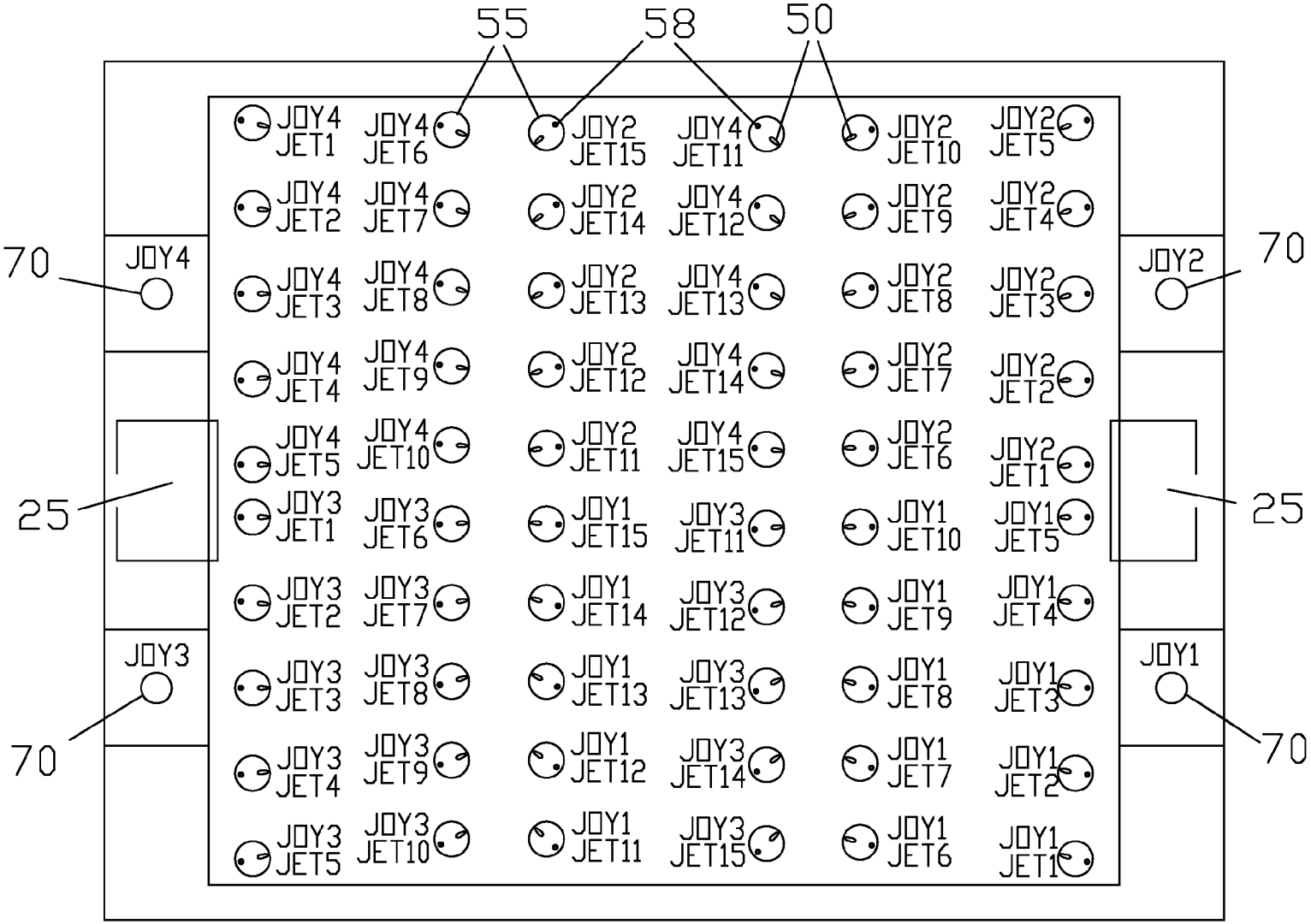
FIG. 5 shows a plan view of a game table suitable for use with as many as four players.

As shown in FIG. 5, a larger play surface 20 would allow for more jets 50, and similarly, would be more suitable for play by larger groups of people. FIG. 5 shows each of four players controlling fifteen jets 50, respectively denoted as JOY1JET1 to JOY1JET15, JOY2JET1 to JOY2JET15, JOY3JET1 to JOY3JET15, and JOY4JET1 to JOY4JET15. It will be appreciated that the jets 50 can be provided with different sizes of openings, to provide a burst of gas having a greater or lesser force than one or more other jets 50. If desired, jets 50 could be positioned at different angles to the plane of the play surface in order to cause the play object 30 to move differently across and above the play surface 20 when directed by different jets 50. This may be desirable where the play surface 20 has varied elevations.

A triggering device such as a joystick 70, having one or more triggers 75, is used to allow a player to selectively direct the flow of gas from the source of compressed gas to a particular jet 50 in order to attempt to move the play object 30. The joystick 70 is tilted in a direction associated with the particular jet 50 to be actuated. Preferably jets 50 are associated with joystick coordinates in an intuitive manner, such that moving the joystick forward corresponds to a player's front-line or "forward" jets and moving the joystick left corresponds to a player's left-side jets. When the trigger 75 is depressed, gas, such as air, flows through the jet 50 associated with the direction of the joystick 70 at the moment that the trigger 75 is depressed. The joystick 70 may be electronic or pneumatic and may be composed of one or more of a variety of materials such as plastic, metal and wood. The joystick 70 may include leather, plastic or rubber grips, and may be of various colours and/or shapes.

Preferably, the joystick 70 is an electronic joystick. When the joystick 70 is an electronic joystick, a signal is sent to a controller, such as a microprocessor 80 with an associated input/output processor 82, when the trigger 75 is depressed. The microprocessor 80 receives the input signal indicating the x-axis and y-axis coordinates of the electronic joystick handle. At the moment that the trigger 75 is depressed, software code executes to cause one of a plurality of valves 90, which may be solenoid valves, to open. Since the electronic joystick 70 is coordinate-based, it can be configured for use with any number of jets 50 by loading conventional software code into the microprocessor 80 which is then programmed for use with the appropriate number of jets 50. In a further embodiment, the rotation of jet modules 55 may be driven by a driver, such as a motor, controlled by the microprocessor 80 to allow a player to rotate the jet module 55 before or during play. In this embodiment, the electronic joystick handle may be twisted in the z-axis to rotate the particular jet module 55 selected by the x-axis and y-axis coordinates of the electronic joystick handle.

The plurality of solenoid valves 90 may be placed together on manifolds and each valve 90 is biased to a closed position, blocking the flow of gas from the source of compressed gas. The source of compressed gas supplies gas, such as air, to the solenoid manifolds 95. The pneumatic tubing 60 connects the outlets of the solenoids to the jets 50 in communication with the play surface 20 by feeding gas from the bottom, beneath the play surface 20. This allows the pneumatic tubing 60 to be hidden under the play surface 20. Sample schematics of the connections between the joysticks 70, controller, manifolds 95, valves 90, source of compressed gas and jet modules 55 (seen from the underside of the table 10) according to the preferred embodiment are shown in FIGS. 7 and 8. The microprocessor 80 is normally programmed such that a particular valve 90 is momentarily opened when the trigger 75 is depressed, which allows a short blast of gas. This helps to conserve the compressed gas. However, the microprocessor 80 may alternatively be programmed such that the valve 90 remains open as long as the player is depressing the trigger 75, in which case the valve 90 will close when the trigger 75 is released or the joystick 70 is moved to a different position. Further, other alternatives may be programmed such as multiple blasts in rapid succession. The joystick 70 may include additional triggers 75 to facilitate rapid firing by the player, as the player does not need to release and re-depress the trigger used to fire the first blast to fire a second blast. The microprocessor 80 and solenoid valves 90 are powered by a power supply 85, which may also be stored beneath the play surface 20. Electrical and pneumatic connections for an embodiment of this configuration are shown in FIGS. 9 to 12.

Figure 13:
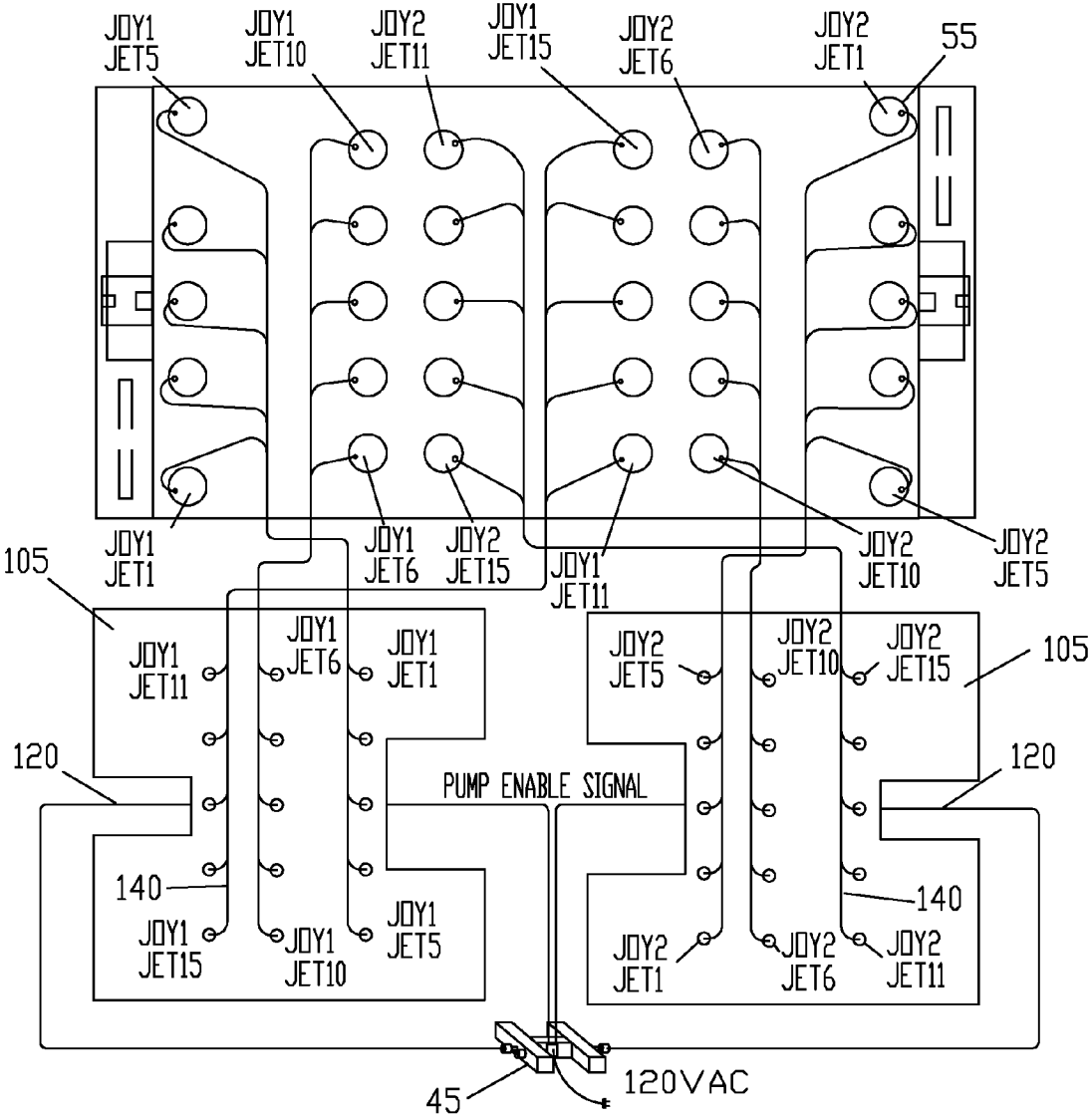
FIG. 13 shows a schematic view of the connections between two pneumatic joysticks, a linear magnetic pump and jet modules.
Figure 14:
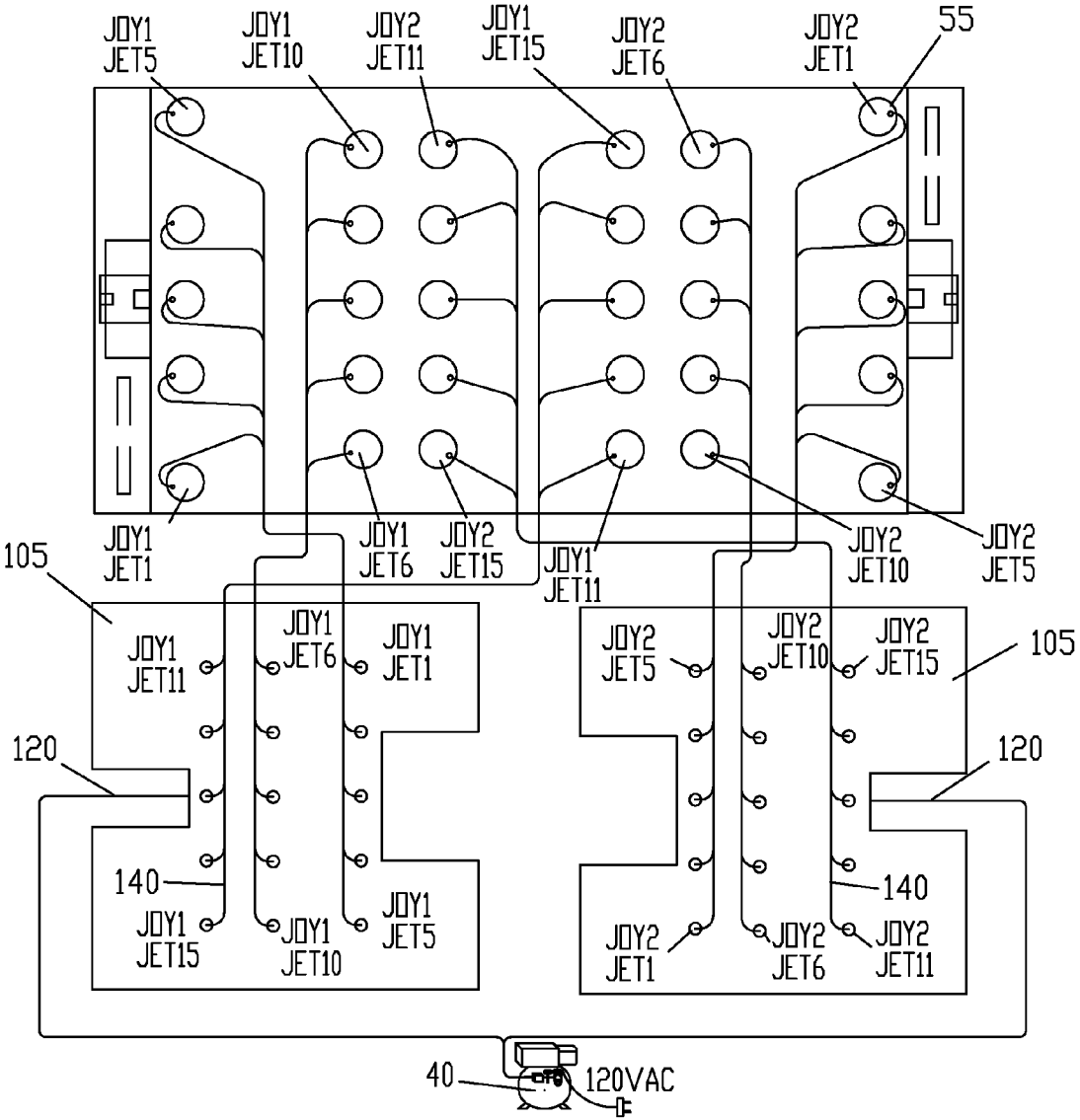
FIG. 14 shows a schematic view of the connections between two pneumatic joysticks, a compressor and jet modules.
Figure 15B:
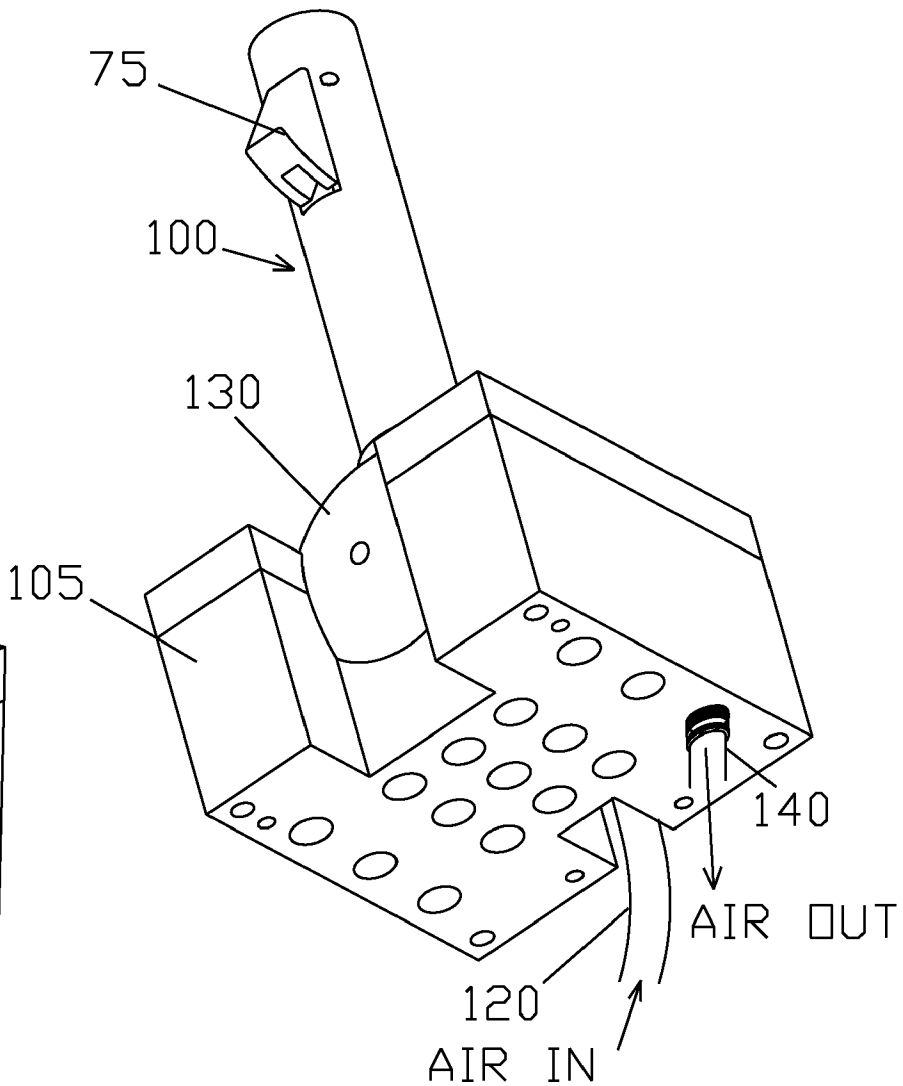
FIGS. 15A and 15B respectively show a rear isometric view and a rear isometric view (from below) of a pneumatic joystick.
Figure 15A:
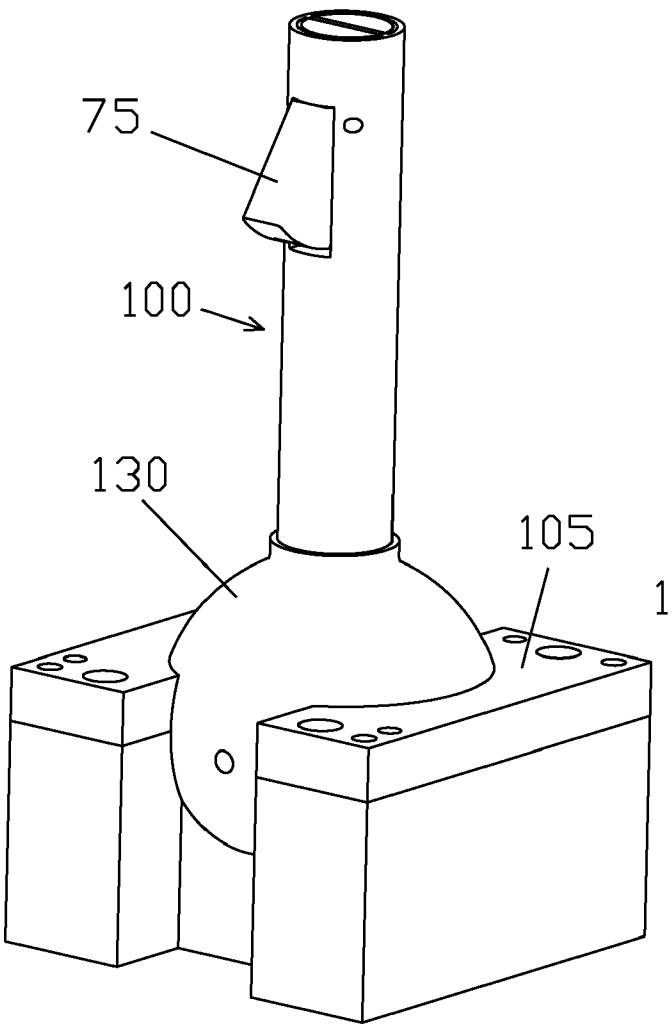
Figures 16A, 16B, 16C, 16D:
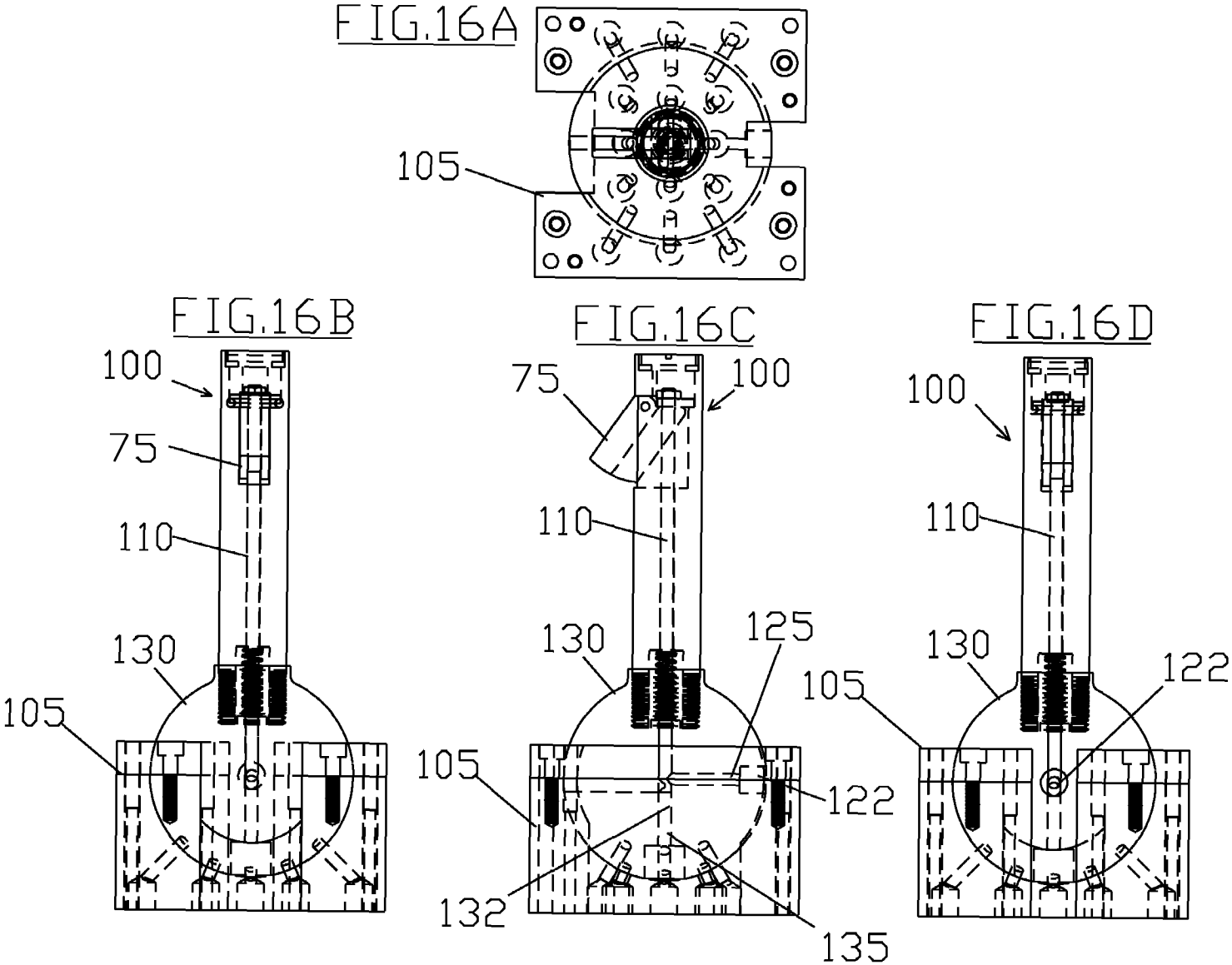
FIGS. 16A to 16D respectively show a bottom side view, rear elevational view, side elevational view and front elevational view of a pneumatic joystick.

Alternatively, the joystick may be a pneumatic joystick 100 as shown in FIGS. 15A, 15B, and 16A to 16D. When a pneumatic joystick 100 is used, the microprocessor 80, the solenoid manifolds 95 and the plurality of solenoid valves 90 are unnecessary. Rather, the pneumatic joystick 100 has a base or joystick manifold 105 providing an output tube 140 in communication with each jet 50 that it triggers. Sample schematics of the connections between the pneumatic joysticks 100, source of compressed gas and jet modules 55 according to this alternative embodiment are shown in FIGS. 13 and 14.

Figure 17A:
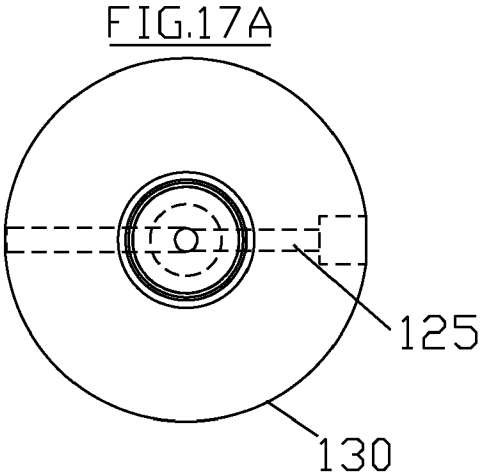
FIGS. 17A to 17C respectively show a top view, a cross-sectional view and a front elevational view of a ball used in the pneumatic joystick of FIGS. 16A to 16D.
Figure 17C:
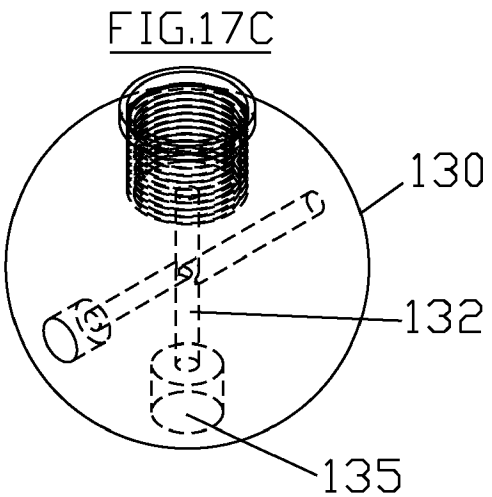
Figure 17B:
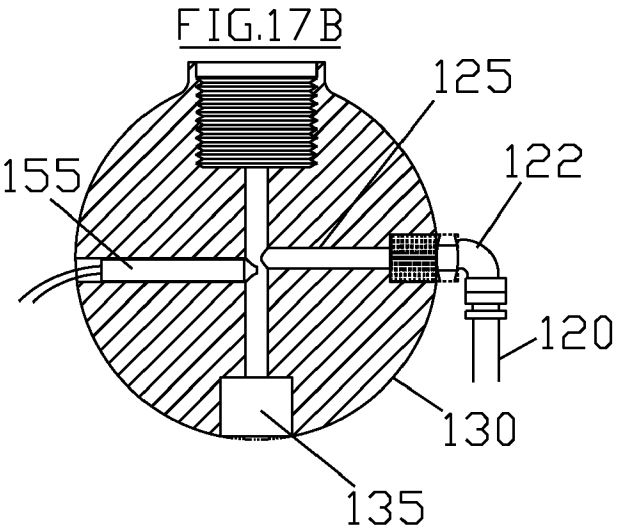
Figure 18C:
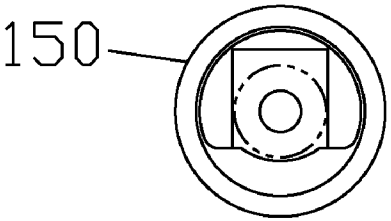
FIGS. 18A to 18C respectively show a side view, a back view and a top sectional view of pneumatic joystick handle.
Figure 18A:
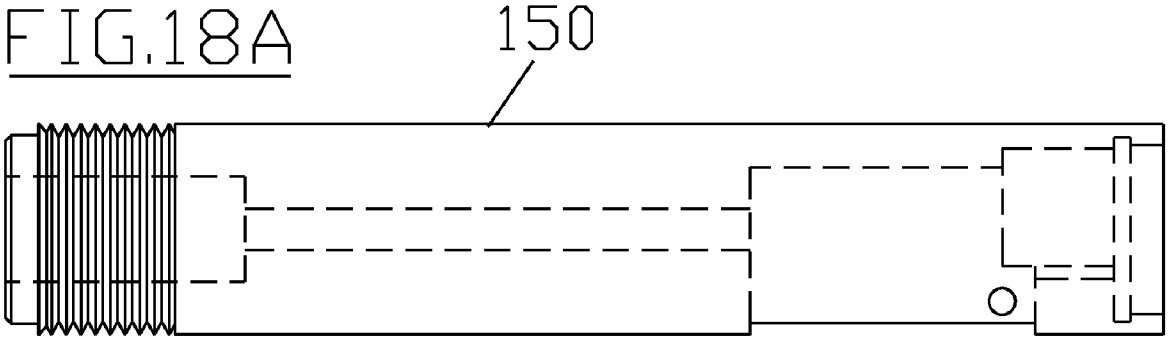
Figure 18B:
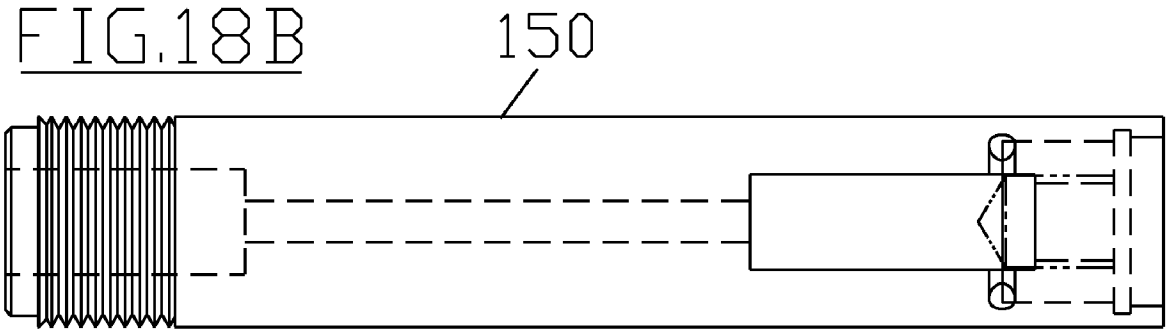
Figure 19A:
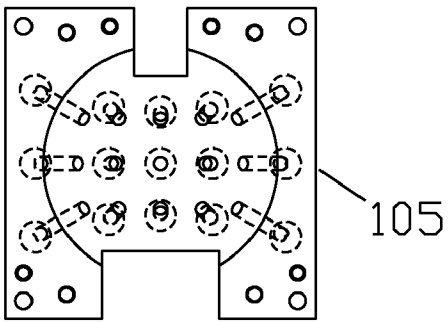
FIGS. 19A to 19E respectively show a top view, a side sectional view, a bottom view, a front sectional view, and an isometric view of the joystick manifold.
Figure 19B:
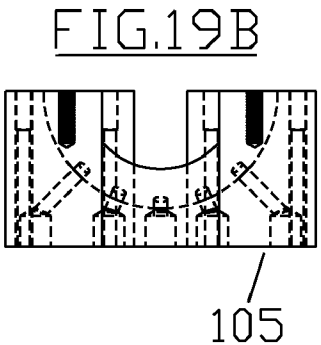
Figure 19C:
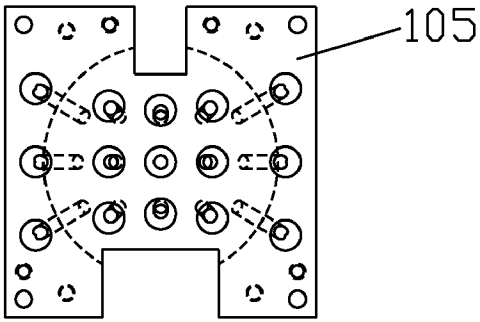
Figure 19D:
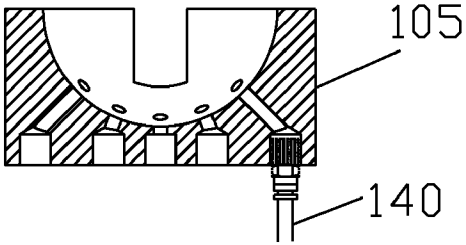
Figure 19E:
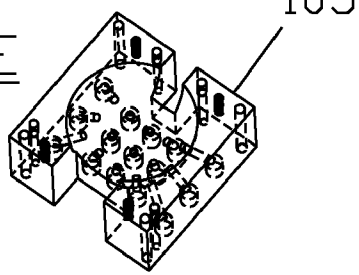

As shown in FIGS. 16A to 16D, the pneumatic joystick 100 may comprise a joystick ball 130 rotated by a member, such as a joystick handle 150, shown in FIGS. 18A to 18C, and adjacent to a manifold 105 feeding output tubes 140. The joystick ball 130, shown in FIGS. 17A to 17C, comprises a gas receiving input 125 and gas delivering output 135. An input tube 120 feeds compressed gas from the source of compressed gas to input 125 via a 90-degree swivel fitting 122. Preferably, the combination of the swivel fitting 122 and the slot cut-out in the joystick housing restricts the movement of the joystick handle 150 substantially to the x-axis and the y-axis so that the joystick handle 150 and trigger 75 do not rotate around the z-axis during play. Output 135 is an orifice in the joystick ball 130 in communication with the input 125 via a conduit 132, that may be aligned to be in communication with one of the plurality of output tubes 140 on the joystick manifold 105, as shown in FIGS. 19A to 19E, through rotation of the joystick ball 130. When the trigger 75 is depressed, it moves a blocking member such as spring loaded metal rod 110 to allow compressed gas to flow from the flexible input tube 120 to one or more of the plurality of output tubes 140.

If a compressor 40 is used as the source of compressed gas, there is constant compressed gas available at the input 125. If an air pump, such as a linear magnetic pump 45, is used, an inductive proximity switch 155 embedded in the joystick ball 130 or an electrical switch interlocked with the trigger 75 can send the air pump a signal which would only allow compressed air at the input 125 when the trigger 75 is depressed. Optionally, a timer can be added to the switch to limit the flow of air to a momentary blast when the trigger 75 is depressed. This 'one-shot' feature could alternatively be achieved mechanically in the trigger switch mechanism in the joystick handle 150. The trigger switch mechanism can be configured to raise the spring loaded metal rod 110 as the trigger 75 is being depressed, but then drop the rod 110 back down once the trigger 75 is fully depressed. If a timer or other mechanism for enabling a one-shot feature is not used, the pneumatic joystick 100 allows compressed gas to continue to flow through one or more of the output tubes 140 as long as the player is depressing the trigger 75. In either case, in this alternative embodiment, little or no compressed gas flows to the jets 50 until the trigger 75 is depressed.

The triggering device need not be an electronic joystick 70 or pneumatic joystick 100. Alternative triggering devices may include a mouse, a trackball, buttons or a touchpad. Further, in an alternative embodiment the joystick 100 can itself serve as a trigger when moved to an actuating position, the centre position of the joystick 100 being neutral and blocking gas from all output tubes 140.

In a further embodiment, a player may compete against a computer-controlled opponent. In this embodiment, sensors, such as distance measuring sensors 180, are used to provide inputs to the microprocessor to determine the coordinates of the play object 30. The microprocessor code then activates one or more appropriate jets 50 based on the location of the play object 30.

The game table 10 may be fitted with either a manual or electronic score keeping mechanism. A manual score keeping mechanism 160 may include numbers or markers that slide to indicate the current score. An electronic score keeping mechanism may include a digital display 170 for displaying the score or point total and sensors 175 to detect when the play object has entered a score or point changing location. Moreover, a speaker module 185, as shown in FIGS. 7 and 8, coupled to the microprocessor 80, programmed with code to control the speaker module 185, could be added to announce scoring and to provide sound effects and, where distance measuring sensors 180 are used, to orally describe the action during play. Such play-by-play commentary might include naming each jet and announcing any of: when a jet passes, shoots, misses shots or passes, scores or prevents a goal. Commentary could also report goals and assists after a goal is scored. Furthermore, if desired, "colour commentary" may be mixed in with the play-by-play commentary.

Various embodiments of the present invention having been thus described in detail by way of example, it will be apparent to those skilled in the art that variations and modifications may be made without departing from the invention. This includes, without limitation, variations in the shape, type and size of the frame, variations in the shape, type and size of the play surface 20, the quantity and specifications of the jets 50, the quantity and specifications of blasts of gas after triggering, the quantity and specifications of score or point changing locations, the quantity and specifications of score keeping mechanisms, the quantity and specifications of openings for play object return 27 or play object entry/re-entry 28, the quantity and specifications of the play objects 30, the quantity and specifications of the triggering devices, including the manner of jet selection, the specification of the controller and its programming if used, the quantity and specifications of the distance measuring sensors 180 if used, the specifications of the coin or credit card mechanism 29 if used, the specifications of the speaker module 185 if used, the location and specifications of the enclosing cover 35, the means of supplying a flow of gas and the specifications of the gas supplied. The invention includes all such variations and modifications as fall within the scope of the appended claims.

I claim:

1. A game comprising:

a frame supporting a play surface, for supporting a play object;

a source of compressed gas capable of providing gas for moving the play object across the play surface;

a plurality of jets in communication with the play surface from underneath the play surface for directing the gas to move the play object across the play surface, the plurality of jets being coupled to the source of compressed gas by a plurality of conduits;

at least one rotatable jet module comprising at least one of the plurality of jets, whereby rotating the jet module changes the direction of the flow of gas from the jet;

one or more triggering devices, each for allowing a player to select one or more jets and selectively trigger the release of gas from the one or more selected jets; and a controller coupled to the triggering devices and a plurality of valves, the plurality of valves being biased towards a closed position which prevents gas flow through the plurality of conduits, whereby the controller selects one or more valves based on the one or more selected jets and causes the one or more selected valves to open in response to the trigger, to allow the gas to move through the one or more selected jets for delivery to the play surface.

2. The game of claim 1, further comprising a driver for rotating the rotatable jet module during play.

3. The game of claim 1, further comprising an enclosed cover.

4. The game of claim 1, further comprising a coin or credit card mechanism.

5. The game of claim 1, wherein the controller includes a microprocessor.

6. The game of claim 1, further comprising a plurality of sensors that provide inputs to the microprocessor, whereby the microprocessor executes code to selectively trigger the gas from one or more jets based on the inputs.

7. The game of claim 6, further comprising a speaker module controlled by the microprocessor for announcing play-by-play commentary.

8. The game of claim 1, wherein the play surface includes one or more score or point changing locations.

9. The game of claim 1, wherein the source of compressed gas is a linear magnetic pump.

10. The game of claim 1, further comprising a score keeping mechanism.

11. A game comprising:

a frame supporting a play surface, for supporting a play object;

a source of compressed gas capable of providing gas for moving the play object across the play surface;

a plurality of jets in communication with the play surface from underneath the play surface for directing the gas to move the play object across the play surface, the plurality of jets being coupled to the source of compressed gas by a plurality of conduits;

at least one rotatable jet module comprising at least one of the plurality of jets, whereby rotating the jet module changes the direction of the flow of gas from the jet; and one or more triggering devices for allowing a player to selectively trigger the gas from at least one jet, the triggering devices coupled to the source of compressed gas and to a plurality of conduits coupled to the plurality of jets, whereby the trigger allows the gas to move from the source of compressed gas through a selected conduit originating at the triggering device to one or more jets and through the one or more jets to the play surface, whereby the selected conduit was selected based on the position of the triggering device.

12. The game of claim 11, further comprising an enclosing cover.

13. The game of claim 11, wherein the play surface includes one or more score or point changing locations.

14. The game of claim 11, wherein the source of compressed gas is a linear magnetic pump.

15. A pneumatic joystick comprising:

an input for receiving gas;

one or more jets associated with a play surface for directing a gas to move a play object across the play surface;

a ball having a conduit one end of which is coupled to the input and the other end of which is aligned to be in communication with at least one of the jets through rotation of the ball;

a ball-rotating member connected to the ball for rotating the ball; and a trigger engaging a blocking member within the ball-rotating member, the blocking member blocking gas from flowing between the input and the jets when the trigger is not depressed, and the trigger moving the blocking member when the trigger is depressed to allow gas to flow between the input and at least one of the jets.

16. The pneumatic joystick of claim 15, further comprising a switch that generates a signal for actuating a pump.

17. The pneumatic joystick of claim 16, further comprising a timer for limiting the duration of a flow of gas when the trigger is depressed.

18. The pneumatic joystick of claim 15, further comprising a mechanism for raising the blocking member as the trigger is being depressed and dropping the blocking member so that it returns to its original position once the trigger is fully depressed.

19. The game of claim 1, wherein the one or more triggering devices allows a player to select one or more jets out of a set of at least two jets associated with that triggering device.

20. The game of claim 11, wherein the one or more triggering devices allows a player to select one or more jets out of a set of at least two jets associated with that triggering device.

* * * * *